US005937516A

United States Patent [19]

De Sousa et al.

[11] Patent Number: 5,937,516

[45] Date of Patent: Aug. 17, 1999

[54] METHOD FOR SPIN FORMING ARTICLES

[75] Inventors: Egas Jose De Sousa; Gregory Lynn Barber, both of Grand Blanc; Donald Richard Tucker, Millington, all of Mich.

[73] Assignee: General Motors Corporation, Detroit, Mich.

[21] Appl. No.: 08/766,269

[22] Filed: Dec. 13, 1996

[51] Int. Cl.[6] ..... B21D 22/16

[52] U.S. Cl. ..... 29/890; 29/516; 29/508; 72/84; 72/85

[58] Field of Search ..... 29/890, 516, 508, 29/515; 72/68, 81, 82, 83, 84, 85

[56] References Cited

U.S. PATENT DOCUMENTS

| | | | |
|---|---|---|---|
| 2,659,128 | 11/1953 | Baldwin, Jr. et al. | 29/148.2 |
| 3,498,245 | 3/1970 | Hansson | 72/126 |
| 3,653,240 | 4/1972 | Huthsing, Jr. | 72/82 |
| 3,793,699 | 2/1974 | Merola | 29/516 |
| 3,793,863 | 2/1974 | Goppini | 72/126 |
| 3,815,397 | 6/1974 | Hollencamp | 72/121 |
| 3,859,831 | 1/1975 | Timmermans | 72/68 |
| 3,975,826 | 8/1976 | Balluff | 29/890 |
| 4,347,219 | 8/1982 | Noritake et al. | 29/890 |
| 4,559,205 | 12/1985 | Hood | 422/180 |
| 4,782,570 | 11/1988 | Spridco | 29/157 R |
| 4,953,376 | 9/1990 | Merlone | 72/84 |
| 5,055,274 | 10/1991 | Abbott | 29/890 |
| 5,245,848 | 9/1993 | Lee, Jr. et al. | 72/84 |
| 5,531,370 | 7/1996 | Rohrberg | 72/78 |
| 5,598,729 | 2/1997 | Hoffmann et al. | 72/81 |

FOREIGN PATENT DOCUMENTS

| | | | |
|---|---|---|---|
| 425983 A1 | 5/1991 | European Pat. Off. | 29/890 |
| 768451 A1 | 1/1997 | European Pat. Off. | 29/890 |
| 0 768 451 A1 | 5/1997 | European Pat. Off. . | |
| 2731965 | 2/1979 | Germany . | |
| 3423223 | 2/1986 | Germany . | |
| 57-202930 | 12/1982 | Japan . | |
| 59-092123 | 5/1984 | Japan . | |
| 92123 | 5/1984 | Japan | 72/85 |
| 193724 | 11/1984 | Japan | 72/83 |

OTHER PUBLICATIONS

J. C. Whitney Catalogue, Side–pipe Turbo Muffler, 1981, p. 130.

*Primary Examiner*—Lee W. Young
*Assistant Examiner*—A. Dexter Tugbang
*Attorney, Agent, or Firm*—Anthony L. Simon; Vince A. Cichosz

[57] ABSTRACT

A method of spin forming, comprising the steps of: providing a tool having a first plurality of forming rollers spaced at a second plurality of distances from a spin axis; spinning around the spin axis at least one member of a set comprising (i) a work piece and (ii) the tool; and engaging the tool and a first end of the work piece. The method allows increased diameter reductions of a free end of a work piece in a single forming operation without collapse of the end of the work piece.

43 Claims, 7 Drawing Sheets

METHOD FOR SPIN FORMING ARTICLES

FIELD OF THE INVENTION

This invention relates to a method of spin forming articles and articles of manufacture according to the method.

BACKGROUND OF THE INVENTION

A typical catalytic converter includes a metal or ceramic substrate treated with a noble metal catalyst enclosed in a stainless steel casing made, for example, out of ASTM 409 stainless steel. A temperature-resistant and shock-absorbing ceramic or wire mesh mat is used to retain the substrate in the casing.

Many catalytic converters have a fusion welded clam shell half type casing to retain the substrate and mat in place. Other catalytic converters have tubular sections with various cross-sectional shapes and transition ends fusion welded in place. Still other catalytic converters have tubular sections with transition ends ram formed to the required dimension. While the ram forming technique is cost effective, it presents rather severe size limitations and, more specifically, ram forming offers a limited range of feasible tubular diameter reduction ratios.

Referring to FIG. 1, an example known catalytic converter 9 includes a tubular stainless steel shell 13 encasing a catalytic converter substrate 11, which is encircled by a mat (not shown). The stainless steel shell 13 has, welded at its ends, transition pieces 15, each typically comprising a stamped member including a generally conical portion 17 and a generally cylindrical portion 19. The cylindrical portion 19 is welded (or clamped) to the exhaust system of the vehicle.

Referring to FIGS. 2–5, an example known spin forming machine 33 is shown. The spin forming machine 33 includes stand 55 with a single or plurality (three, as shown in FIGS. 2 and 3) of forming rollers 25 rotatively attached thereto. The rollers 25 each have a tapered face 27 and are equally distant from a common axial centerline. The spin forming machine 33 has a mandrel 35 to internally support a tubular metal piece 29 to be operated on.

The spin forming machine 33 is supported on a platform 37. The piece 29 and/or stand 55 is rotated and, depending upon the material used for piece 29, the piece 29 is heated while the platform 37 is indexed toward the piece 29. FIG. 3 illustrates the initial outer diameter 51 of the piece 29. As the roller tapered faces 27 make contact with the piece 29, the diameter of the portion of the piece 29 in the machine 33 is reduced to an outer diameter 53 shown in FIG. 4.

To achieve the amount of tapered reduction desirable in many types of articles, such as a catalytic converter to replace the converter shown in FIG. 1, two or more machines 33 applying two or more reduction steps to the piece 29 are necessary.

SUMMARY OF THE INVENTION

It is an object of this invention to provide a method of spin forming articles according to claim 1.

Advantageously, this invention provides a method of spin forming articles that reduces the number of spin forming steps to achieve a high diameter reduction ratio.

Advantageously, this invention allows increased diameter reduction ratios of a free end of a work piece in a single spin forming operation without collapse of the end of the work piece.

Advantageously, this invention provides a method of spin forming articles useful in the manufacture of catalytic converters.

Advantageously, this invention provides a method of spin forming articles such as catalytic converters that achieves the desired diameter reduction ratio in a single spin forming step.

Advantageously, this invention provides a method of spin forming articles that utilizes a forming tool having a plurality of forming rollers spaced at different distances from a spin axis. The rollers extend from the tool a variety of lengths with the longest rollers spaced furthest from the spin axis. During spinning, the longest roller located at the furthest distance from the spin axis first engages the work piece, achieving a first diameter reduction of the end of the work piece. As the tool and work piece continue to engage, the second longest roller, located at a second furthest distance from the spin axis engages the end of the work piece that has been reduced in diameter by the first roller, so that the second roller continues to reduce the diameter of the end of the work piece while the first roller continues to operate further into the work piece.

Advantageously, additional rollers may be provided if desired, having successively shorter lengths and located successively closer to the spin axis to continue the diameter reduction of the work piece begun by the first two rollers. Advantageously, the progression of the work piece through the two or more rollers having different heights and different distances from the spin axis achieves multiple reduction steps of the work piece end in a single spin-forming operation.

Advantageously, according to an example, this invention provides a method of spin forming, comprising the steps of: spinning around a spin axis at least one member of a set comprising (i) a work piece and (ii) a tool; engaging the tool and a first end of the work piece to simultaneously form a plurality of conical diameter reduction portions on the first end of the work piece, wherein an axially aligned annular flat portion is formed between each two adjacent conical diameter reduction portions.

Advantageously, according to another example, this invention provides a method of spin forming, comprising the steps of: providing a first tool having a first plurality of forming rollers spaced at a second plurality of unequal distances from a spin axis; spinning around the spin axis at least one member of a set comprising (i) a work piece and (ii) the first tool; and imparting an axial movement on at least one member of the set to engage the first tool and a first end of the work piece.

Advantageously, according to a preferred example, the first plurality of forming rollers contains at least first and second forming rollers, wherein the first forming roller is longer that the second forming roller and wherein the first forming roller is at a first radial distance from the spin axis greater than a second radial distance of the second forming roller from the spin axis.

Advantageously, according to another preferred example, the method of spin-forming according to this invention also comprises the steps of: removing the first end of the work piece from the first tool and then engaging a second end of the work piece on the first tool.

Advantageously, according to yet another preferred example, a the method of spin-forming according to this invention also comprises the step of: providing a second tool having a third plurality of forming rollers spaced at a fourth plurality of unequal distances from the spin axis, wherein the step of spinning imposes a relative spin movement between the work piece and the second tool and wherein the step of imparting the axial movement also engages the second tool to a second end of the work piece to simultaneously form both the first and second ends of the work piece.

BRIEF DESCRIPTION OF THE DRAWINGS

The present invention will now be described by way of example with reference to the following drawings in which.

DESCRIPTION OF THE PREFERRED EMBODIMENT

Figure 1:
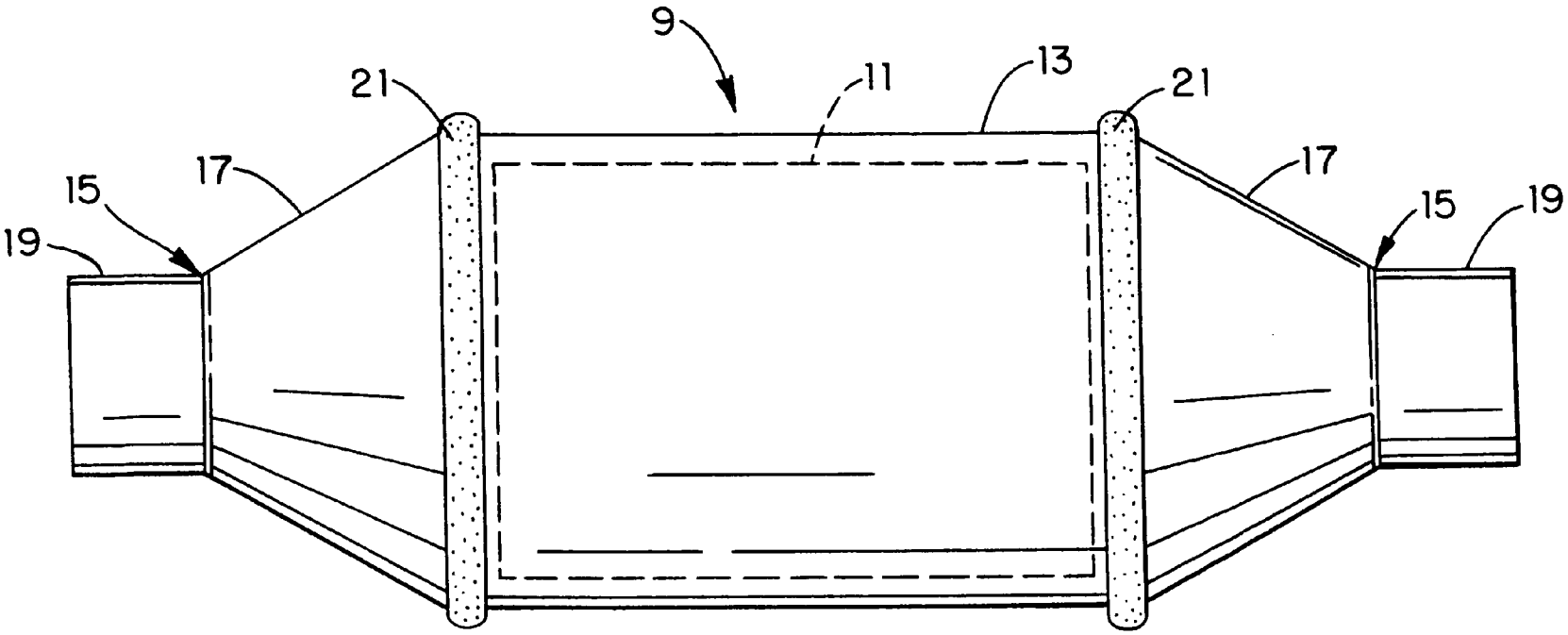
PRIOR ART FIG-1
FIG. 1 is a side elevation view of an example prior art catalytic converter.
Figure 3:
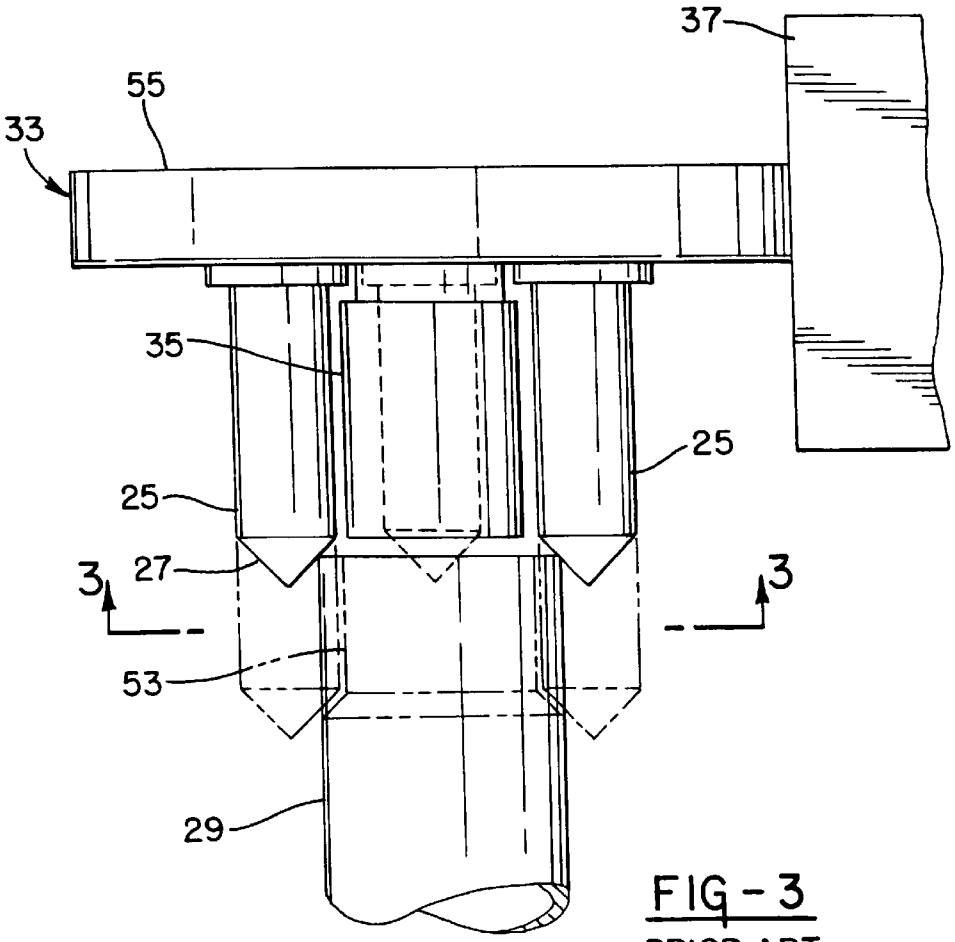
FIG-3 PRIOR ART
FIGS. 2 through 5 illustrate a prior art method of spin forming an end of a tubular work piece before the present invention.
Figure 2:
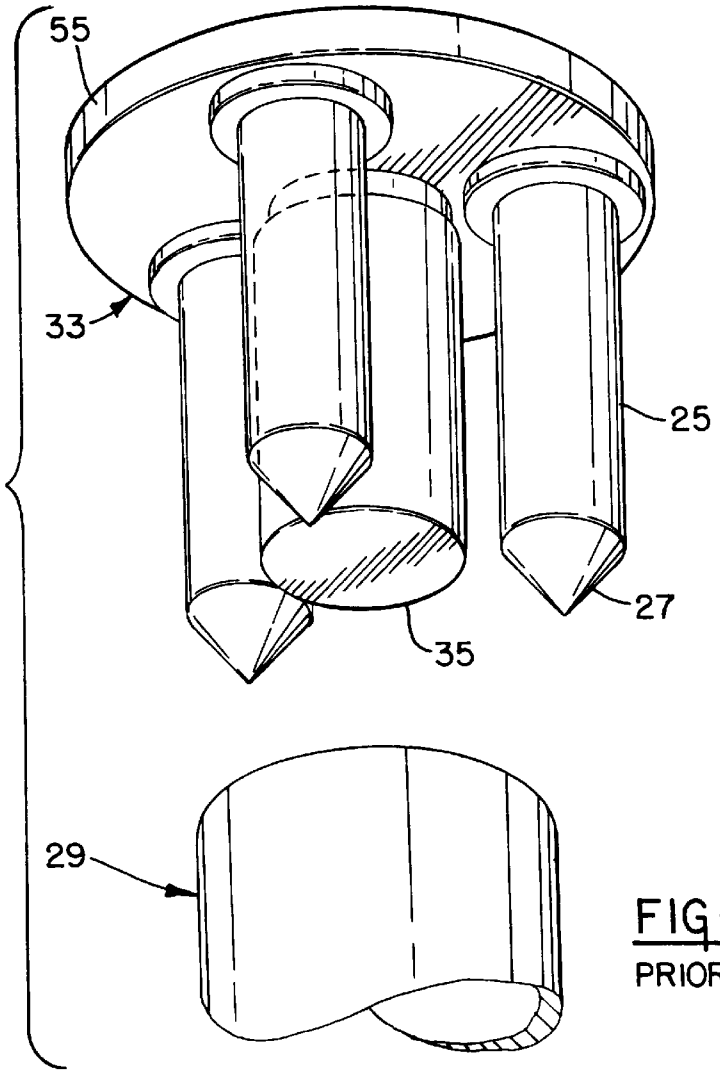
FIG-2 PRIOR ART
Figure 6:
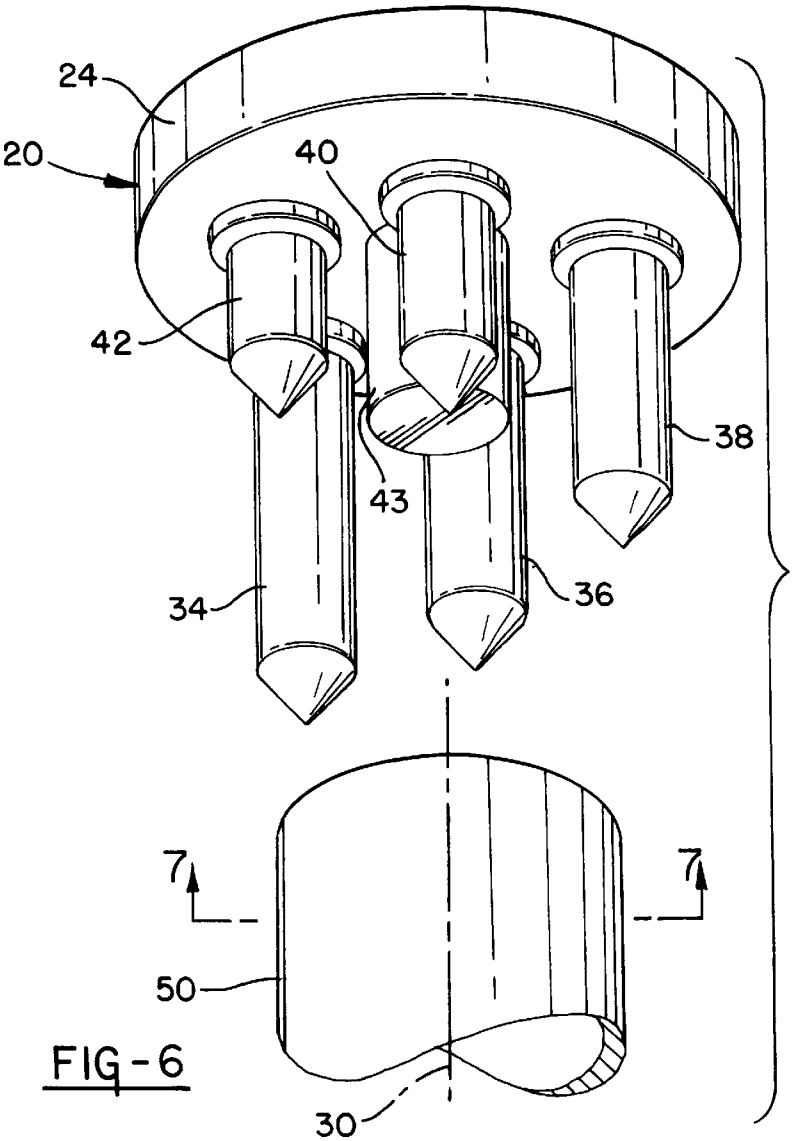
FIGS. 6 through 9 illustrate various views of an example apparatus used for spin forming a work piece according to the present invention.
Figure 4:
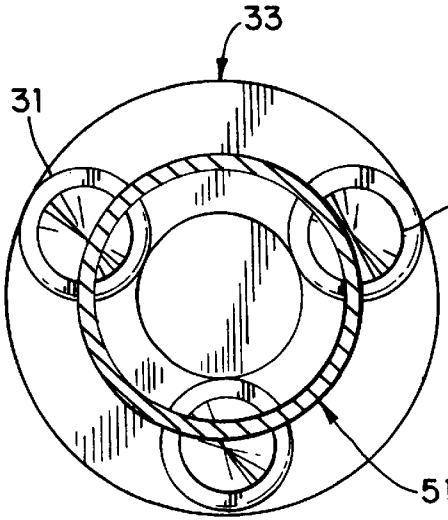
FIG-4 PRIOR ART
Figure 5:
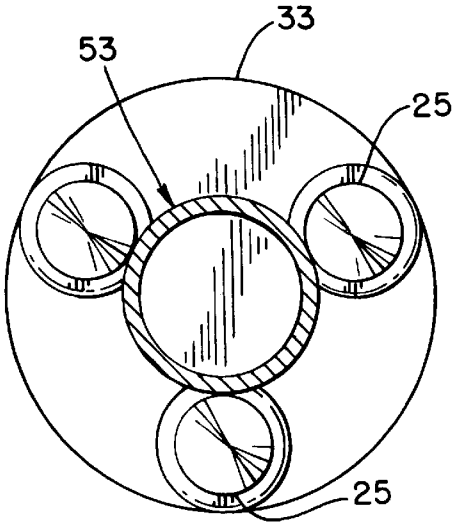
FIG-5 PRIOR ART

Referring to FIGS. 6–9, spin forming machine 20 has a platform 22, which is translatable in the axial direction parallel to spin axis 30 toward the tubular work piece 50. The spin forming machine 20 has a stand 24 and a plurality of rollers 34, 36, 38, 40 and 42. Each of the aforementioned rollers are at a different radial distance from an axial centerline 30 (also referred to as the spin axis) of the tubular work piece 50 and mandrel 43 with the roller 42 being most radially inward and the rollers 40, 38, 36 and 34 being progressively more radially outward. The rollers 34, 36, 38, 40 and 42 project different lengths from the stand 24, with roller 42, closest to the spin axis 30, being the shortest, and rollers 40, 38, 36 and 34 being progressively longer.

A motor-driven mechanism is provided for spinning the stand 24 along with the rollers 34, 36, 38, 40 and 42, or for spinning the work piece 50, about the spin axis 30, or for spinning both the stand 24 and the work piece 50 relative to each other. Such spinning mechanisms are well known to those skilled in the art and need not be set forth herein in detail. Before the work piece 50 and the stand 24 with rollers 34, 36, 38, 40 and 42 are engaged, supplemental heat may be provided to the work piece 50 in a well-known manner to allow the work piece 50 to be formed by the rollers 34, 36, 38, 40 and 42. Those skilled in the spin forming arts will readily recognize that such supplemental heat may not be necessary in all cases, as the requirement of supplemental heating depends upon the type of metal constituting work piece 50.

After a relative spin motion between stand 24 and work piece 50 is achieved, and supplemental heating is provided, if desired, the platform 22 is indexed parallel to axis 30 toward the work piece 50, carrying the stand 24 and rollers 34, 36, 38, 40 and 42 into engagement with the work piece 50. The roller 34, which is radially most outwardly and extends closest to the unengaged work piece, is the first to come in contact with the work piece 50.

Figure 8:
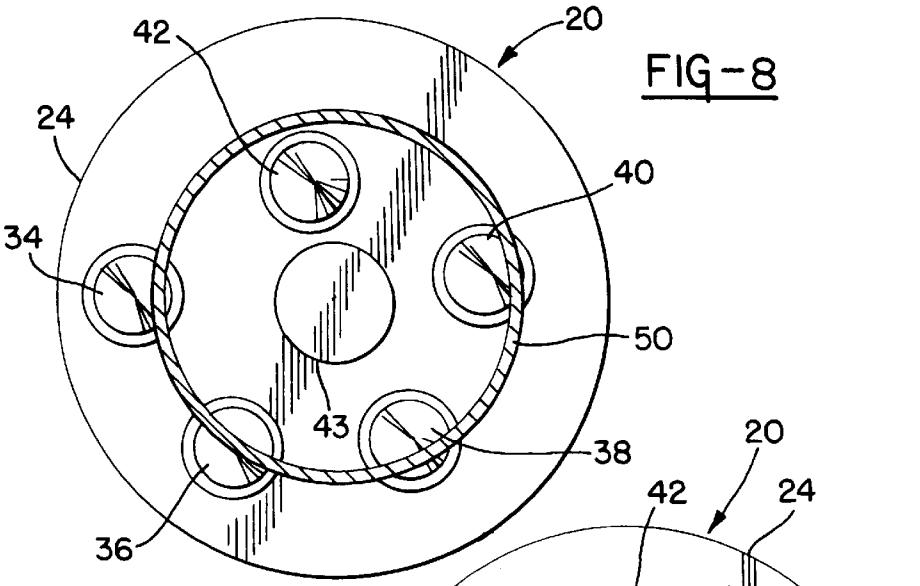
Figure 9:
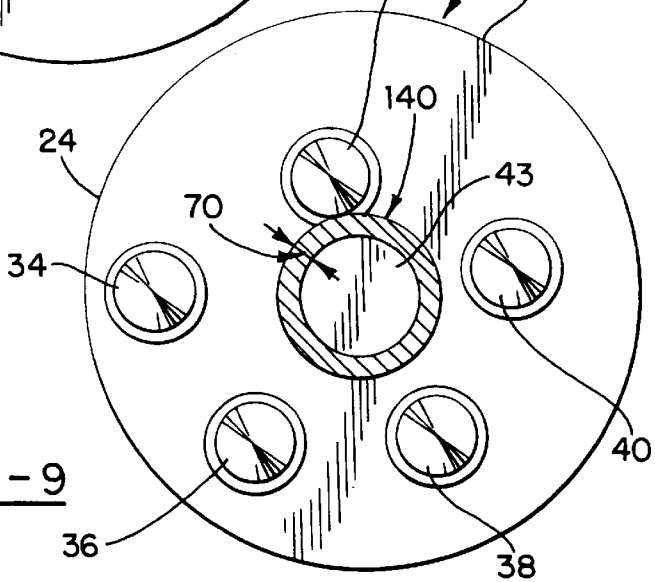
Figure 7:
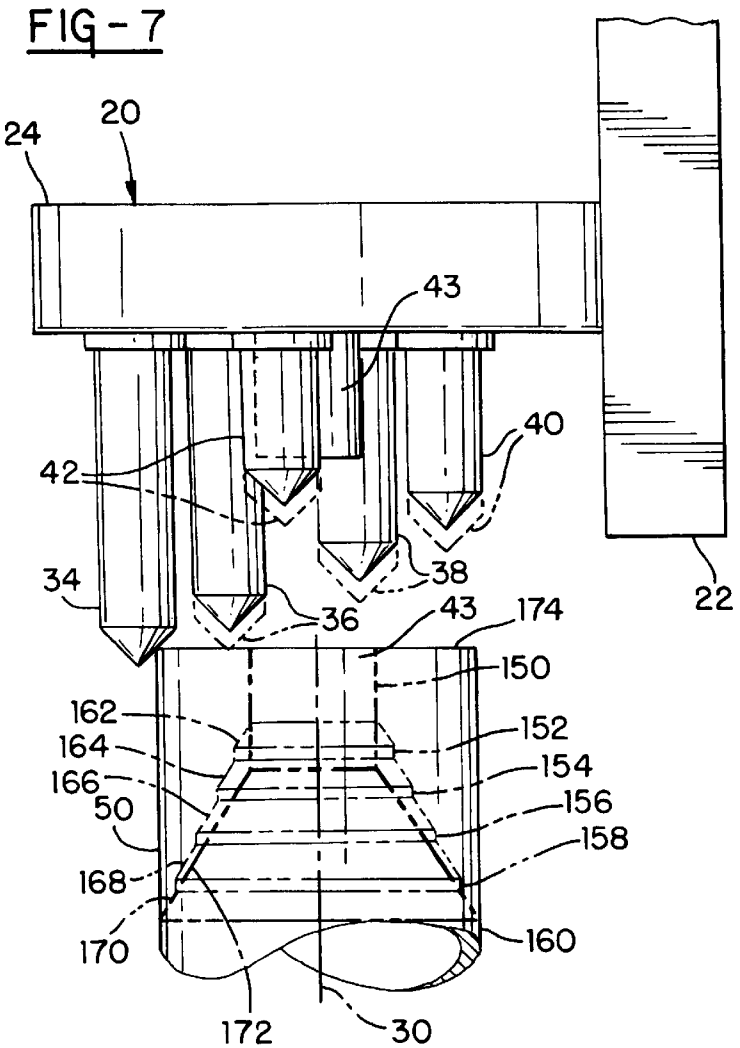

FIG. 8 illustrates the original diameter of the work piece 50 with respect to the position of rollers 34, 36, 38, 40 and 42. The starting diameter of the work piece 50 is of a size to engage the tapered end of roller 34. As engagement of the machine 20 and work piece 50 continues, roller 34 works on the end 174 of work piece 50 to reduce the diameter thereof to that of the annular axially aligned flat 158 (FIG. 7). With further engagement, the roller 36 begins operating on the end 174 of the work piece 50, reducing the diameter thereof to that of flat 156. As the engagement is continued to move the rollers onto the work piece 50, rollers 38, 40 and 42 sequentially begin engaging the end 174 of the work piece 50 to reduce its diameter progressively to the diameters indicated by flats 154, 152 and 150, respectively, wherein flat 150 is the final desired reduced diameter portion of the end of the work piece 50, and is supported during the spin forming operation by mandrel 43.

After complete engagement of the roller 42 and mandrel 43, the formed work piece 50 has a shape that progresses from its initial outer diameter 160, through a series of alternating tapered steps (also referred to as diameter reduction sections) 170, 168, 166, 164, 162 and flat sections (i.e., constant diameter sections) 158, 156, 154 and 152 to the final inner diameter 150. At this point, the formed work piece 50 may be removed from the machine 20 if desired.

It will be recognized that the spin forming described above is conducted in a progressive manner without having all rollers initiating contact with the tubular element 50 at the same time. This progressive feature helps prevent the tubular element 50 from collapsing and allows end 174 to be spin formed to a much smaller diameter 140 than previously allowable.

Each flat 152, 154, 156 and 158 adds hoop strength to the end 174 of the work piece 50 being operated on, providing structural support spaced at axial intervals along the portion of work piece 50 within the rollers 34, 36, 38, 40 and 42. Thus the formation of the flats 152, 154, 156 and 158 interposed between the diameter reduction sections 162, 164, 166, 168 and 170 advantageously helps prevent collapse or other undesirable deformation of the work piece during the spin forming. The flats 152, 154, 156 and 158 are achieved by selecting the height of each roller 34, 36, 38, 40 and 42 so that the tapered end of each roller 36, 38, 40 and 42 first engages the outer work piece 50 at a location axially spaced from the largest diameter end of the tapered head of the previous roller 34, 36, 38 and 40.

If it is not desirable to leave the finished work piece 50 with the series of flats 152, 154, 156 and 158 between the diameter reduction sections 162, 164, 166, 168 and 170, the flats can be removed by providing that each of the rollers 36, 38, 40 and 42 be individually translatable in the axial direction between two positions with respect to the work piece 50. This may be achieved using a series of actuators either located in the stand 24 or the platform 22 and coupled through the stand 24, i.e., through cam mechanisms or other suitable coupling means well known to those skilled in the art, that selectively operate on the rollers 36, 38, 40 and 42.

The rollers start in the positions shown in solid lines to achieve the above-described operation. Then the individually translatable rollers 36, 38, 40 and 42 are operated sequentially to remove the flats 152, 154, 156 and 158 and merge the diameter reduction sections 162, 164, 166, 168 and 170 into a single diameter reduction section 172. First roller 36 is extended axially, operating on diameter reduction portion 168, bringing it in line with diameter reduction portion 170, eliminating the flat 158. Rollers 38, 40 and 42 are likewise extended in sequence to operate on the diameter reduction sections 166, 164 and 162, respectively, eliminating flats 156, 154 and 152 so that the work piece 50 achieves the single conical diameter reduction section 172 shown.

Figure 11:
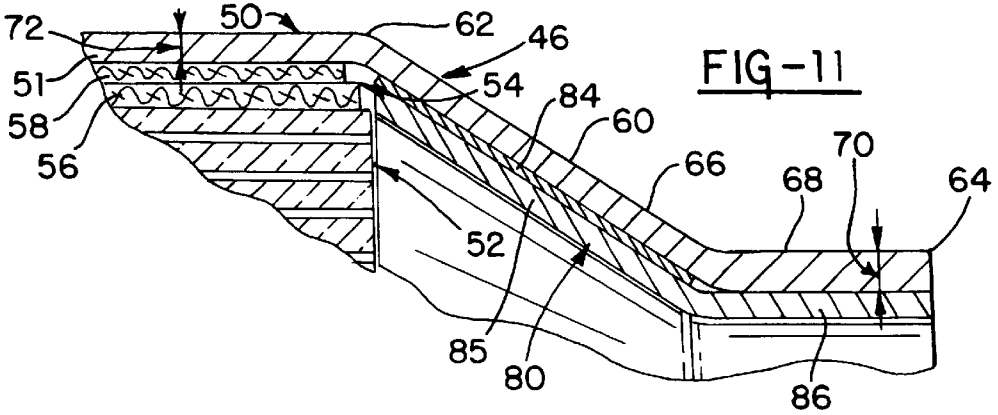
FIG. 11 is an enlargement of a portion of the catalytic converter shown in FIG. 10.
Figure 10:
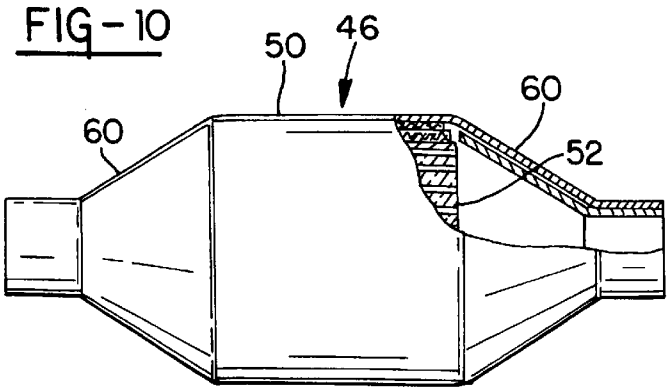
FIG. 10 is a partially sectioned side elevation view of an example catalytic converter formed according to an example of the present invention.

Referring to FIGS. 10 and 11, according to one example, the work piece 50 is operated on both ends to form the casing of catalytic converter 46. A substrate 52 wrapped in multiple layered matting 54, which includes a first inner layer 56 and an outer layer 58 is located within casing 50.

The casing 50 has two opposite transition pieces or ends 60. The ends 60 have a first diameter 62, and a second diameter 64 which is smaller than the first diameter 62. As shown in FIGS. 10 and 11, each end 60 has a conical portion 66 with a base joined to the remainder of the casing 50. Additionally, each conical portion 66 has extending therefrom a cylindrical extension 68, typically having a thickness 70 that is greater than the thickness 72 of the portion of the casing 50 surrounding the substrate 52.

To manufacture the catalytic converter 46, the substrate 52 is wrapped in the matting 54. The wrapped substrate 52 is then inserted within the work piece 50 either after forming of one of the ends 60 or before forming of both of the ends 60. The ends 60 are spin formed by a spin forming machine 20, for example, as described above. If thermal insulation of the ends 60 is desired, before each end 60 is formed, a metal inner end cone 80 is placed on the mandrel 43 of the machine 20. When the work piece (casing) 50 engages the rollers, the rollers 34, 36, 38, 40 and 42 form end 60 radially exterior of the inner end cone 80. Inner end cone 80 is provided with a shape so that its conical portion 85 is space inward of the final formed position of end 60, allowing for an air gap to act as insulation. Alternatively, an insulating material 84, i.e., a matting of a known type, may be wrapped around the conical portion 85 of inner end cone 80 prior to the forming of end 60, so that, after forming, the matting material serves as insulation between the conical portion 85 of inner end cone 80 and the conical portion 66 of casing 50. During the spin forming of end 60 around inner end cone 80, the tubular extension 68 and tubular portion 86 of inner end cone 80 become fixedly joined, i.e., similar to a tight friction fit between the two pieces.

In another example for manufacturing the catalytic converter 46, two machines 20 are provided, one for operating on each end of the converter 46 to simultaneously form the ends 60. In this example, the substrate 52, wrapped in matting 54, is inserted into the work piece 50 before the roll forming of ends 60 is initiated. Inner end cones 80 are placed on both mandrels 43 of the machines 20 and, when either the work piece 50 or stands 24 are rotating, the stands 24 with the rollers are both indexed toward the work piece 50 to simultaneously form the ends 60.

Figure 13:
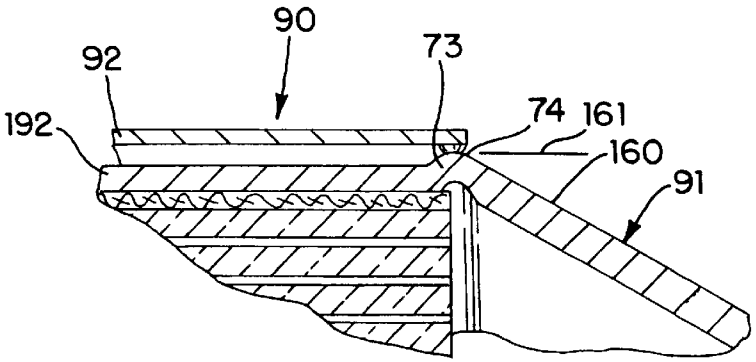
FIG. 13 is an enlargement of a portion of the catalytic converter shown in FIG. 12.
Figure 12:
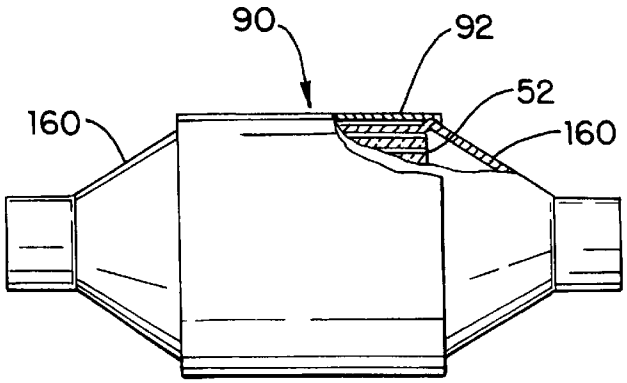
FIG. 12 is a view similar to FIG. 10 of another example catalytic converter formed according to an example of the present invention.

In FIGS. 12 and 13, catalytic converter 90 includes a spin formed casing 91 with a housing portion 192, within which substrate 52 is located, and two ends 160. Two ridges 74 (only one shown) extend radially outwardly from housing portion 192, one ridge 74 where housing portion 192 transitions to each end 160. The ridges 74 may be formed by the following method. Before forming each end 160, each end of the work piece that will form casing 91 is formed, i.e., by roll forming or other suitable method, to expand the end to a slightly increased diameter 161 at transition points 73 (only one shown). The transition 73 from the original diameter of work piece 91 to the increased diameter 161 occurs at the locations where ridges 74 are desired. When the ends are formed as described above, the longest roller is sized so that the largest diameter portion of end 160 occurs proximate to the transition 73, thus forming ridge 74. An external outer insulation tubular element 92 is then attached to the casing 91 by welding to the opposed external ridges 74 in a known manner.

Figure 14:
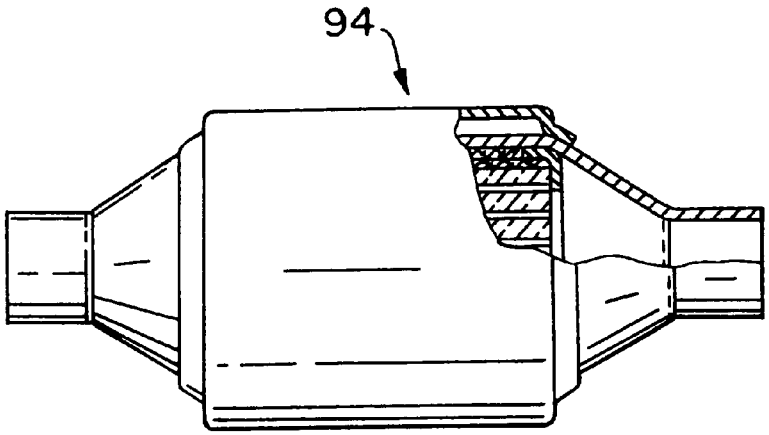
FIG. 14 is a view similar to FIG. 10 of another example catalytic converter formed according to an example of the present invention.
Figure 15:
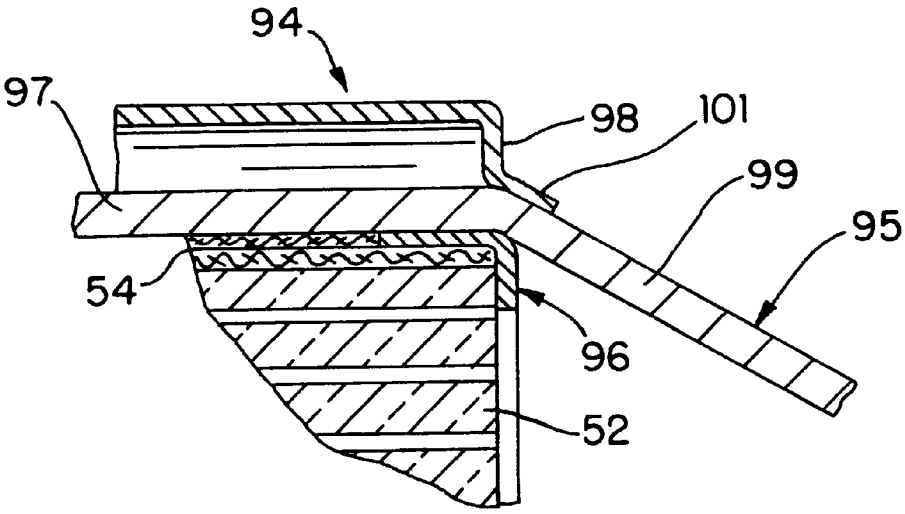
FIG. 15 is an enlargement of a portion of FIG. 14.

Referring to FIGS. 14 and 15, the catalytic converter 94 includes two annular L-shaped brackets 96 (only one shown), one located at each end of the substrate 52 to position the matting 54 and substrate 52. The brackets 96, similar to brackets known for use in prior art catalytic converters having metal monolith substrates, are locked in place within housing portion 97 of casing 95 when the ends 99 are formed as described above. An example heat shield 98 is provided with an annular lip 101 or a series of arcuately spaced tabs that extend radially until the shield 94 is placed over the casing 95, at which point the lip 101 or tabs are formed down on the ends 99 of casing 95 by a suitable pressing operation and may, if desired, also be welded in place.

Figure 16:
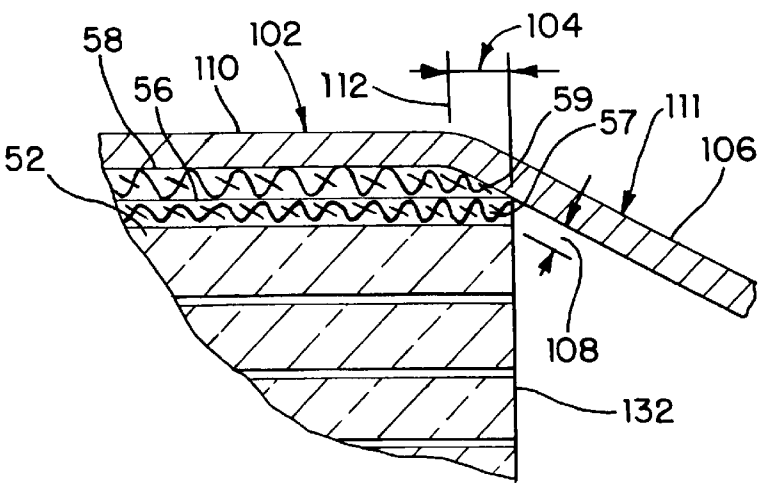

Referring to FIG. 16, catalytic converter 102 includes substrate 52 with end faces 132 (only one shown) extending a distance 104 in the axial direction past each base 112 of the conical ends 106 of casing 111. The housing portion 110 of casing 111 surrounds most of inner and outer mats 58 and 56, respectively, which also have ends 57 and 59 extending into the conical ends 106. During the forming of the conical ends 106, the ends 57, 59 of the mats 56, 58 are compressed in the distance 104 within the conical ends 106. The resulting compressive force holds the mats 56, 58 and substrate 132 in place.

Figure 17:
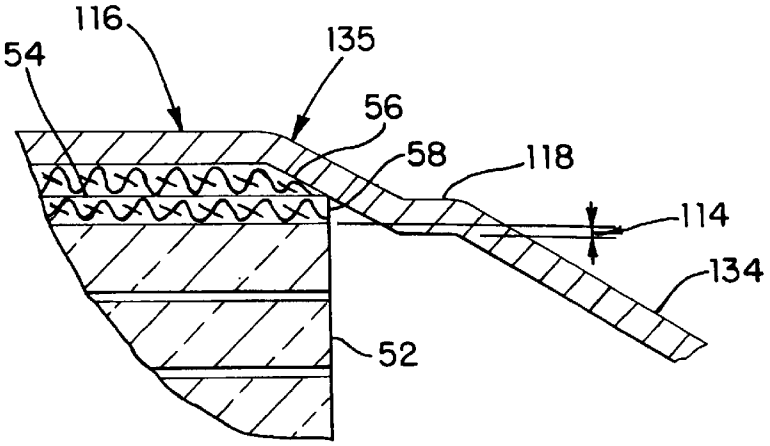
FIGS. 16, 17 and 18 are enlarged views similar to the view of FIG. 10 of another example catalytic converter formed according to an example of the present invention.

Referring to FIG. 17, at least one annular flat 118 is retained on the catalytic converter 116. The flat 118 offers added strength to the conical end 134 of the casing 135 and is positioned with an inner radius a distance 114 less than the outer radius of substrate 52 to direct the flow of gasses (right to left) into the substrate 52 and away from the matting 54.

Figure 18:
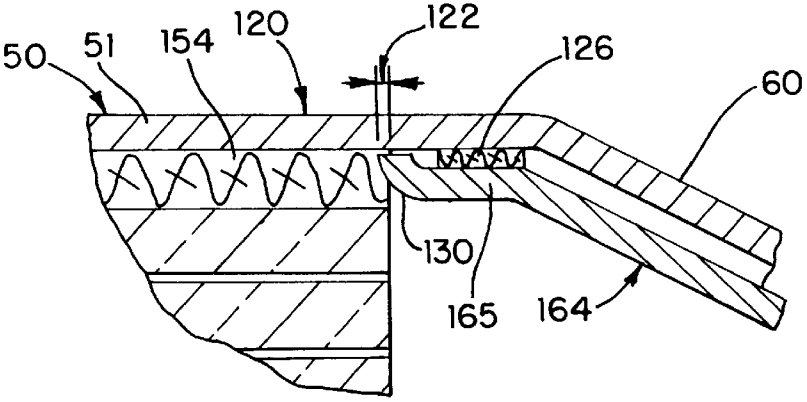

Referring to FIG. 18, catalytic converter 120 has an inner end cone 164 that serves as an insulator similar to inner end cone 80 of FIG. 11. Inner end cone 164 includes an axial extension 165 that extends axially into the housing portion 51 of casing 50. An annular matting 126 is trapped between the axial extension 165 and casing 50 by the annular curved leg 130 on the end of the axial extension 165. The annular curved leg 130 extends a distance 122 into the matting 154 to help keep the matting 154 in place.

We claim:

1. A method of spin forming, comprising the steps of:

providing a first tool having a first plurality of forming rollers, wherein the first plurality of forming rollers includes at least first and second forming rollers, wherein the first forming roller is at a first radial distance from a spin axis greater than a second radial distance of the second forming roller from the spin axis;

spinning around the spin axis at least one member of a set comprising (i) a work piece having a cylindrical shape and an inner wall with a first diameter and (ii) the first tool; and imparting an axial motion on at least one member of the set to engage the first tool and a first end of the work piece to sequentially engage the first forming roller and then the second forming roller to the work piece, wherein the inner wall of the first end is formed down to a second diameter by the first forming roller, wherein the second diameter is less than the first diameter, and wherein the inner wall of the first end is formed down to a third diameter by the second forming roller, wherein the third diameter is less than the second diameter.

2. A method of spin forming according to claim 1, wherein the first forming roller is longer than the second forming roller and wherein each forming roller of the first plurality of forming rollers is axially parallel to the spin axis.

3. A method of spin forming according to claim 2, wherein the first plurality of forming rollers also comprises third, fourth and fifth forming rollers, wherein the third forming roller is longer than the fourth forming roller and the fourth forming roller is longer than the fifth forming roller, wherein the third forming roller is at a third radial distance from the spin axis greater than a fourth radial distance from the spin axis of the fourth forming roller and wherein the fourth radial distance from the spin axis is greater than a fifth radial distance from the spin axis of the fifth forming roller.

4. A method of spin forming according to claim 2, wherein the first forming roller forms on the first end a first tapered portion and the second forming roller forms a second tapered portion, wherein a substantially axially aligned flat is formed between the first and second tapered portions.

5. A method of spin forming according to claim 4, also comprising the step of, after all of the forming rollers of the first plurality of forming rollers engage the work piece, axially extending the second forming roller relative to the first forming roller to remove the flat.

6. A method of spin forming according to claim 1, also comprising the steps of:

removing the first end of the work piece from the first tool; and engaging a second end of the work piece to the first tool.

7. A method of spin forming according to claim 1, also comprising the steps of:

removing the work piece from the first tool;

placing a substrate within the work piece; and engaging a second end of the work piece to the first tool, wherein a fourth diameter of a second end of the work piece is reduced, trapping the substrate substantially within an unreduced housing portion of the work piece.

8. A method of spin forming according to claim 7, wherein the work piece is formed into a catalytic converter.

9. A method of spin forming according to claim 8, wherein a flat is formed on the first end adjacent to an axial end of the substrate, wherein the flat has an inner diameter at least as small as an outer diameter of the substrate.

10. A method of spin forming according to claim 7, also comprising the step of placing an annular L-shaped bracket at each end of the substrate within the work piece before the engaging of the second end of the work piece to the first tool.

11. A method of spin forming according to claim 7, also comprising the step of placing an insulating matting material between an outer perimeter of the substrate and an inner perimeter of an unreduced portion of the work piece.

12. A method of spin forming according to claim 11, wherein the first and second ends of the work piece each have a conical shape, wherein the substrate and matting material extend axially into the first and second ends, wherein the first and second ends compress portions of the matting material extending axially into the first and second ends.

13. A method of spin forming according to claim 1, wherein the first end of the work piece is spin formed around a conical shaped member.

14. A method of spin forming according to claim 13, wherein the engaging of the rollers on the work piece forms a diameter transition portion connecting a first portion of the first end formed down by the rollers and a second portion of the work piece in which the inner wall retains the first diameter, wherein the conical shaped member is spaced away from the inner wall of the diameter transition portion of the first end.

15. A method of spin forming according to claim 1, wherein individual rollers of the first plurality of rollers extend to axial positions relative to one another so that, during engagement of the first tool and the first end of the work piece, at least two progressively decreasing diameter sections are formed on the first end of the work piece with a substantially axially aligned annular flat section formed between the at least two progressively decreasing diameter sections.

16. A method of spin forming according to claim 15, wherein the annular flat section provides hoop strength to the first end during spin forming, thereby allowing increased diameter reduction of the first end while preventing against collapse thereof.

17. A method of spin forming according to claim 15, also comprising the step of, after all of the forming rollers of the first plurality of forming rollers engage the work piece, axially extending at least one forming roller of the first plurality of forming rollers to remove the annular flat section.

18. A method of spin forming according to claim 1, also comprising the step of, during engagement of the first tool and the first end of the work piece, after all of the forming rollers of the plurality of forming rollers engage the work piece, selectively axially extending individual forming rollers of the first plurality of forming rollers.

19. A method of spin forming according to claim 1, wherein, during engagement of the first tool and the first end of the work piece, a second plurality of progressively decreasing diameter sections are formed on the first end of the work piece, wherein, between each two of the second plurality of progressively decreasing diameter sections that are adjacent to one another, a substantially axially aligned annular flat section is formed.

20. A method of spin forming according to claim 19, wherein the substantially axially aligned annular flat portions provide hoop strength to the end being formed, thereby allowing increased diameter reduction of the first end while preventing against collapse thereof.

21. A method of spin forming according to claim 19, also comprising the step of, after all of the forming rollers of the first plurality of forming rollers engage the work piece, selectively axially extending individual forming rollers of the first plurality of forming rollers to remove at least some of the flats.

22. A method of spin-forming according to claim 1, also comprising the step of: providing a second tool having a second plurality of forming rollers including at least a third forming roller spaced a third radial distance from the spin axis and a fourth forming roller spaced a fourth radial distance from the spin axis, wherein the step of spinning imposes a relative spin movement between the work piece and the second tool and wherein the step of imparting the axial movement also engages the second tool to a second end of the work piece to simultaneously form both the first and second ends of the work piece.

23. A method according to claim 22, also comprising the step of placing a substrate within the work piece prior to the simultaneous forming of the first and second ends of the work piece.

24. A method according to claim 23, wherein the work piece is formed into a catalytic converter.

25. A method of spin forming, comprising the steps of:

spinning around a spin axis at least one member of a set comprising (i) a work piece and (ii) a first tool having a plurality of forming rollers wherein said first tool includes at least first and second forming rollers;

engaging the first tool and a first free end of the work piece to simultaneously form a plurality of tapered inner diameter reduction portions on the first end of the work piece, wherein an axially aligned annular flat portion is formed between each two adjacent tapered inner diameter reduction portions;

said engaging step imparting an axial motion on at least one member of the set to engage the first tool and the first free end of the work piece to sequentially engage the first forming roller and then the second forming roller to the work piece, wherein the inner wall of the first free end is formed down to a second diameter by the first forming roller, wherein the second diameter is less than the first diameter and wherein the inner wall of the first free end is formed down to a third diameter by the second forming roller, wherein the third diameter is less than the second diameter.

26. A method of spin forming according to claim 25, wherein each flat portion provides hoop strength to the first free end, thereby allowing increased diameter reduction of the first free end while preventing against collapse thereof.

27. A method of spin forming according to claim 25, wherein the first and second forming rollers are spaced at first and second distances from the spin axis, wherein the first distance is unequal to the second distance, wherein during the engaging step the first and second forming rollers engage the work piece.

28. A method of spin forming according to claim 27, also comprising the step of, after the first and second forming rollers engage the work piece, axially extending the second forming roller to remove at least one of the flat portions.

29. A method of spin forming according to claim 27, wherein the first forming roller is longer than the second forming roller, and wherein the first distance is greater than the second distance.

30. A method of spin forming according to claim 25, also comprising the steps of:

removing the first free end of the work piece from the first tool; and engaging a second end of the work piece to the first tool.

31. A method of spin forming according to claim 25, wherein the step of engaging the first free end of the work piece to the first tool reduces a first diameter of the first free end, also comprising the steps of:

removing the work piece from the first tool:

placing a substrate within the work piece; and engaging a second end of the work piece to the first tool, wherein a second diameter of a second end of the work piece is reduced, trapping the substrate substantially within an unreduced housing portion of the work piece.

32. A method of spin forming according to claim 31, wherein the work piece is formed into a catalytic converter.

33. A method of spin forming according to claim 31, also comprising the step of placing an annular L-shaped bracket at each end of the substrate within the work piece before the engaging of the second end of the work piece to the first tool.

34. A method of spin forming according to claim 31, also comprising the step of placing an insulating matting material between an outer perimeter of the substrate and an inner perimeter of an unreduced portion of the work piece.

35. A method of spin forming according to claim 34, wherein the first and second ends of the work piece each have a conical shape, wherein the substrate and matting material extend axially into the first and second ends, wherein the first and second ends compress portions of the matting material extending axially into the first and second ends.

36. A method of spin forming according to claim 31, wherein a flat is formed on the first end adjacent to an axial end of the substrate, wherein the flat has an inner diameter at least as small as an outer diameter of the substrate.

37. A method of spin forming according to claim 31, wherein the substrate is wrapped in a matting material.

38. A method of spin forming according to claim 37, wherein the first end is spin formed around a conical shaped member, wherein the conical shaped member includes an axially extending end that extends into contact with the matting material to maintain the matting material in place.

39. A method of spin forming according to claim 25, wherein the first end is spin formed around a conical shaped member.

40. A method of spin-forming according to claim 25, also comprising the steps of:

providing a second tool, wherein the step of spinning imposes a relative spin movement between the work piece and the second tool; and engaging the second tool and a second free end of the work piece, wherein the first and second free ends of the work piece are simultaneously formed.

41. A method according to claim 40, also comprising the step of placing a substrate within the work piece prior to the simultaneous forming of the first and second free ends.

42. A method according to claim 41, wherein the work piece is formed into a catalytic converter.

43. A method of spin forming, comprising the steps of:

providing a tool having a plurality of forming rollers, wherein the forming rollers extend from the tool a variety of axial lengths, wherein members of the plurality of rollers with longer axial lengths are spaced further from a spin axis than members of the plurality with shorter axial lengths, wherein the plurality includes at least one longest forming roller and one second longest forming roller;

imparting a relative spinning motion about the spin axis between the tool and a work piece;

moving the tool and the work piece together, wherein the longest forming roller, located at a furthest distance from the spin axis, first engages the work piece, achieving a first inner diameter reduction of the end of the work piece, wherein, as the tool and the work piece are moved further together, the second longest roller, located at a second furthest distance from the spin axis, engages the end of the work piece that has been reduced in inner diameter by the longest forming roller, wherein the second forming roller continues to reduce the inner diameter of the end of the work piece while the first forming roller continues to operate further, in an axial direction, into the work piece.

* * * * *